US008240381B2

(12) United States Patent
Menard et al.

(10) Patent No.: US 8,240,381 B2
(45) Date of Patent: Aug. 14, 2012

(54) DRAINING A RESERVOIR WITH AN INTERBEDDED LAYER

(75) Inventors: Wendell Peter Menard, Katy, TX (US); Wayne Reid Dreher, Jr., Katy, TX (US); John L. Stalder, Calgary (CA)

(73) Assignee: ConocoPhillips Company, Houston, TX (US)

( * ) Notice: Subject to any disclaimer, the term of this patent is extended or adjusted under 35 U.S.C. 154(b) by 297 days.

(21) Appl. No.: 12/708,832

(22) Filed: Feb. 19, 2010

(65) Prior Publication Data

US 2010/0206555 A1 Aug. 19, 2010

Related U.S. Application Data

(60) Provisional application No. 61/153,816, filed on Feb. 19, 2009.

(51) Int. Cl.
*E21B 43/24* (2006.01)

(52) U.S. Cl. ..... 166/272.2; 166/272.7

(58) Field of Classification Search ..... 166/272.2, 166/272.7
See application file for complete search history.

(56) References Cited

U.S. PATENT DOCUMENTS

| | | | |
|---|---|---|---|
| 3,116,792 A | 1/1964 | Purre | |
| 4,059,151 A | 11/1977 | Terry | |
| 4,101,172 A | 7/1978 | Rabbitts | |
| 4,151,877 A | 5/1979 | French | |
| 5,016,709 A | 5/1991 | Combe et al. | |
| 5,377,756 A | 1/1995 | Northrop et al. | |
| 6,016,873 A | 1/2000 | Hsu et al. | |
| 6,158,517 A | 12/2000 | Hsu | |
| 7,073,577 B2 | 7/2006 | Yu | |
| 7,077,198 B2 | 7/2006 | Vinegar et al. | |
| 7,128,150 B2 | 10/2006 | Thomas et al. | |
| 7,404,441 B2 | 7/2008 | Hocking | |
| 7,441,603 B2 | 10/2008 | Kaminsky et al. | |
| 2005/0161216 A1 | 7/2005 | Zupanick | |
| 2007/0039729 A1* | 2/2007 | Watson et al. | 166/245 |
| 2007/0289736 A1 | 12/2007 | Kearl et al. | |
| 2008/0164030 A1 | 7/2008 | Young | |
| 2008/0210423 A1 | 9/2008 | Boney | |
| 2010/0108317 A1* | 5/2010 | Cimolai | 166/272.3 |
| 2010/0175872 A1* | 7/2010 | Brown et al. | 166/258 |

* cited by examiner

*Primary Examiner* — William P Neuder
(74) *Attorney, Agent, or Firm* — ConocoPhillips Company

(57) ABSTRACT

Methods and systems relate to recovering hydrocarbons from within formations in which hydrocarbon bearing reservoirs are separated from one another by a fluid flow obstructing natural stratum. Relative to the reservoirs, the stratum inhibits or blocks vertical fluid flow within the formation. Drilled bores arranged to intersect the stratum provide an array of fluid flow paths through the stratum. Fluid communication established by the drilled bores enables production utilizing a producer borehole deviated from vertical and processes that rely on techniques such as gravity drainage through the fluid flow paths and/or injection through the fluid flow paths.

7 Claims, 4 Drawing Sheets

DRAINING A RESERVOIR WITH AN INTERBEDDED LAYER

CROSS-REFERENCE TO RELATED APPLICATIONS

None

STATEMENT REGARDING FEDERALLY SPONSORED RESEARCH OR DEVELOPMENT

None

FIELD OF THE INVENTION

Embodiments of the invention relate to methods and systems for recovering hydrocarbons.

BACKGROUND OF THE INVENTION

Viscous properties of heavy oil and bitumen make such products difficult and expensive to extract from underground reservoirs. Techniques used to recover the products include thermal and solvent based recovery processes that reduce viscosity of the products in-situ in order to enable flow of the products into production wells. Gravity drainage of the reservoirs once the products are made mobile relies on ability to have vertical fluid flow.

Economic viability for any recovery method depends on amount of hydrocarbons recoverable as determined by thickness of the reservoirs. However, inter-bedded impermeable layers act as barriers to vertical flow compartmentalizing multiple stratified reservoirs that are developed independent of one another. While as a collective group the stratified reservoirs may have sufficient thickness to be economical for production, the impermeable layers limit applicability of the recovery processes, such as cyclic steam stimulation (CSS), steam assisted gravity drainage (SAGD), vapor extraction (VAPEX), and in-situ combustion (ISC).

Vertical wells allow contact with each of the stratified reservoirs but are often not produced at economic rates. Horizontal wells expose an areal extent of the reservoir to a wellbore and enable recovery corresponding to the areal extent. Even with horizontal or undulating wells, the impermeable layers isolating the areal extent from other reservoirs above or below the impermeable layers may limit viability for economic production.

Therefore, a need exists for improved methods and systems for oil recovery from formations having reservoirs separated vertically by a stratum less permeable than the reservoirs.

SUMMARY OF THE INVENTION

In one embodiment, a method of recovering hydrocarbons from a formation includes forming a production wellbore in a formation having two or more stratified reservoirs separated by one or more impermeable layers and forming a conditioning wellbore traversing at least one of the impermeable layers in two or more locations within the formation. The production wellbore traverses at least one of the impermeable layers and is deviated from vertical. Further, the traversing at least one of the impermeable layers by the conditioning wellbore permits fluid communication of the stratified reservoirs separated by the impermeable layer and allows production through the production wellbore of the two or more stratified reservoirs across the one or more impermeable layers.

According to one embodiment, a method of recovering hydrocarbons from a formation includes drilling first and second bores through a stratum having lower permeability than hydrocarbon bearing first and second reservoirs and recovering in a section of a production wellbore hydrocarbons from both the first reservoir and the second reservoir. The first reservoir and the second reservoir are stratified such that the first reservoir is separated from the second reservoir by the stratum. In addition, the section of the production wellbore is deviated from vertical and disposed in the first reservoir with the first and second bores establishing fluid communication between the second reservoir and the section of the production wellbore.

For one embodiment, a production system for recovering hydrocarbons from a formation includes first and second drilled bores through a stratum having lower permeability than hydrocarbon bearing first and second reservoirs. The first reservoir and the second reservoir are stratified such that the first reservoir is separated from the second reservoir by the stratum. The system includes a production wellbore having a section that is deviated from vertical and disposed in the first reservoir in fluid communication with both the first reservoir and the second reservoir. The first and second drilled bores define part of fluid flow paths between the second reservoir and the section of the production wellbore.

BRIEF DESCRIPTION OF THE DRAWINGS

The invention, together with further advantages thereof, may best be understood by reference to the following description taken in conjunction with the accompanying drawings.

DETAILED DESCRIPTION OF THE INVENTION

Embodiments of the invention relate to methods and systems for recovering hydrocarbons from within formations in which hydrocarbon bearing reservoirs are separated from one another by a fluid flow obstructing natural stratum. Relative to the reservoirs, the stratum inhibits or blocks vertical fluid flow within the formation. Drilled bores arranged to intersect the stratum provide an array of fluid flow paths through the stratum. Fluid communication established by the drilled bores enables production utilizing a producer borehole deviated from vertical and processes that rely on techniques such as gravity drainage through the fluid flow paths and/or injection through the fluid flow paths.

In some embodiments, the reservoirs contain the hydrocarbons that may be fluids, such as heavy oils or bitumen, with initial API gravity less than 25°, less than 20°, or less than 10°. Some embodiments may produce form two, three or more different stratified regions even though two or three are shown by example herein. One or more of the reservoirs may define a vertical thickness of less than 5.0 meters (m), less than 10 m, or less than 20 m.

The stratum defines a layer with lower permeability to fluid flow than the reservoirs. For some embodiments, layers of shale form the stratum. The stratum initially obstructs or prevents fluid communication between the reservoirs and may be impermeable in a natural state to flow of fluids such as the hydrocarbons or steam.

Figure 1:
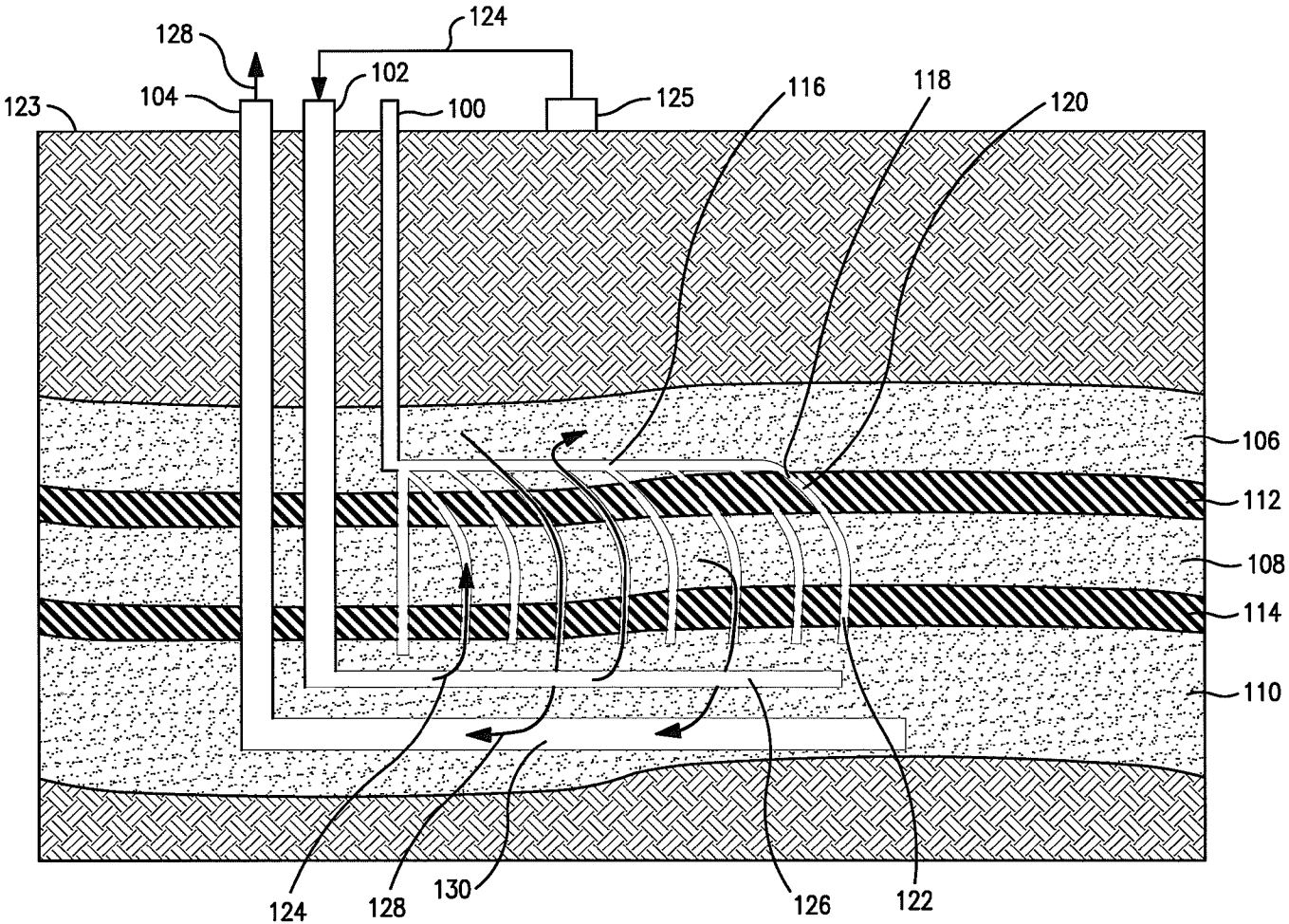
FIG. 1 is a schematic of a formation with top-down stratum puncturing boreholes arranged to facilitate hydrocarbon recovery utilizing an injection well and a production well, according to one embodiment of the invention.

FIG. 1 shows a formation conditioning well 100, an injector well 102, and a producer well 104 drilled into earth. The wells 100, 102, 104 enable production of hydrocarbons from a hydrocarbon bearing first reservoir 106, a hydrocarbon bearing second reservoir 108, and a hydrocarbon bearing third reservoir 110. A first stratum 112 and a second stratum 114 respectively separate the first reservoir 106 from the second reservoir 108 and the second reservoir 108 from the third reservoir 110.

The conditioning well 100 includes a common borehole 116 deviated from vertical and from which a plurality of lateral boreholes 118 extend. The lateral boreholes 118 follow a downward trajectory off of the common borehole 116 disposed within the first reservoir 106. At different locations, each of the lateral boreholes 118 intersects the first stratum 112 and the second stratum 114. Such intersection by the lateral boreholes 118 defines separate and spaced apart first fluid flow paths 120 through the first stratum 112 and separate and spaced apart second fluid flow paths 122 through the second stratum 114. In some embodiments, the lateral boreholes 118 form an array with each of the lateral boreholes 118 offset from one another. Based on number of the lateral boreholes 118, the array of the lateral boreholes 118 punctures each of the first stratum 112 and the second stratum 114 at least five times, at least ten times, or at least fifteen times.

For some embodiments, the injector well 102 passes through the first and second reservoirs 106, 108 and the first and second stratums 112, 114 to reach the third reservoir 110 located below the first and second reservoirs 106, 108 and the first and second stratums 112, 114. An interior of the injector well 102 lacks direct fluid communication to the first and second reservoirs 106, 108 where in contact with the first and second reservoirs 106, 108 since the injector well 102 may be cased with solid wall tubing along a length of the injector well 102 from surface 123 to the third reservoir 110. A deviated from vertical injector portion 126 of the injector well 102 passes within the third reservoir 110. The injector portion 126 extends lengthwise in an orientation deviated from vertical corresponding with a direction that the lateral boreholes 118 are offset from one another as determined by orientation of the common borehole 116.

Steam 124 introduced into the injector well 102 exits the injector well 102 through the injector portion 126 and enters the third reservoir 110. The injector well 102 couples to a steam source or steam generator 125 that supplies the steam 124. Slotted or perforated liner wall sections or open-hole enable outflow of the steam 124 along the injector portion 126. The steam 124 passes through the third reservoir 110 and the second fluid flow paths 122 to heat and mix with the hydrocarbons in the second reservoir 108. The first fluid flow paths 120 establish fluid communication between the first reservoir 106 and the steam 124 coming from the injector portion 126 to also heat the hydrocarbons in the first reservoir 106. Relative to permeability of the first reservoir 106, the common borehole 116 creates a streak of high permeability across the first reservoir 106. The common borehole 116 thus facilitates dispersion of the steam 124 throughout the first reservoir 106 even though the steam 124 is introduced into the first reservoir 106 at discrete locations through the first fluid flow paths 120. Further, placement of the common borehole 116 within either the first reservoir 106 or the second reservoir 108 leaves sufficient vertical space within the third reservoir 110 for both the producer well 104 and the injector well 102 without interference by the common borehole 116.

The producer well 104 gathers production fluid 128 including the hydrocarbons drained from the first, second and third reservoirs 106, 108, 110, upon the hydrocarbons from the first reservoir 106 being drained through the first and second fluid flow paths 120, 122 and the hydrocarbons from the second reservoir 108 being drained through the second fluid flow paths 122. Like the injector well 102, the producer well 104 also passes through the first and second reservoirs 106, 108 and the first and second stratums 112, 114 to reach the third reservoir 110. For some embodiments, the producer well 114 includes a vertically deviated (e.g., horizontal) section 130 that is disposed below (e.g., 4 to 6 meters below) and parallel to the injector portion 126 of the injector well 102. The section 130 of the producer well 104 passes within the third reservoir 110 and has slotted or perforated liner wall sections or is open-hole to enable inflow of the hydrocarbons. The section 130 thereby extends lengthwise parallel to the common borehole 116 and in an orientation deviated from vertical corresponding with the direction that the lateral boreholes 118 are offset from one another.

Even if the hydrocarbons within the first reservoir 106 and/or second reservoir 108 are not heated by contact with the steam 124, the lateral boreholes 118 may enable draining of the hydrocarbons from the first and second reservoirs 106, 108. Injecting the steam 124 to produce the hydrocarbons from the third reservoir 110 may occur prior to completing the conditioning well 100. Whenever the conditioning well 100 is drilled, the lateral boreholes 118 make possible gravity induced flow from the first and second reservoirs 106, 108 to the section 130 of the producer well 104. Without direct steam contact, heat transfer across the second stratum 114 to heat the second reservoir 108 and then across the first stratum 112 to heat the first reservoir 106 may cause the hydrocarbons from the first and second reservoirs 106, 108 to become mobile enough for the gravity induced flow toward the section 130 of the producer well 104.

Figure 2:
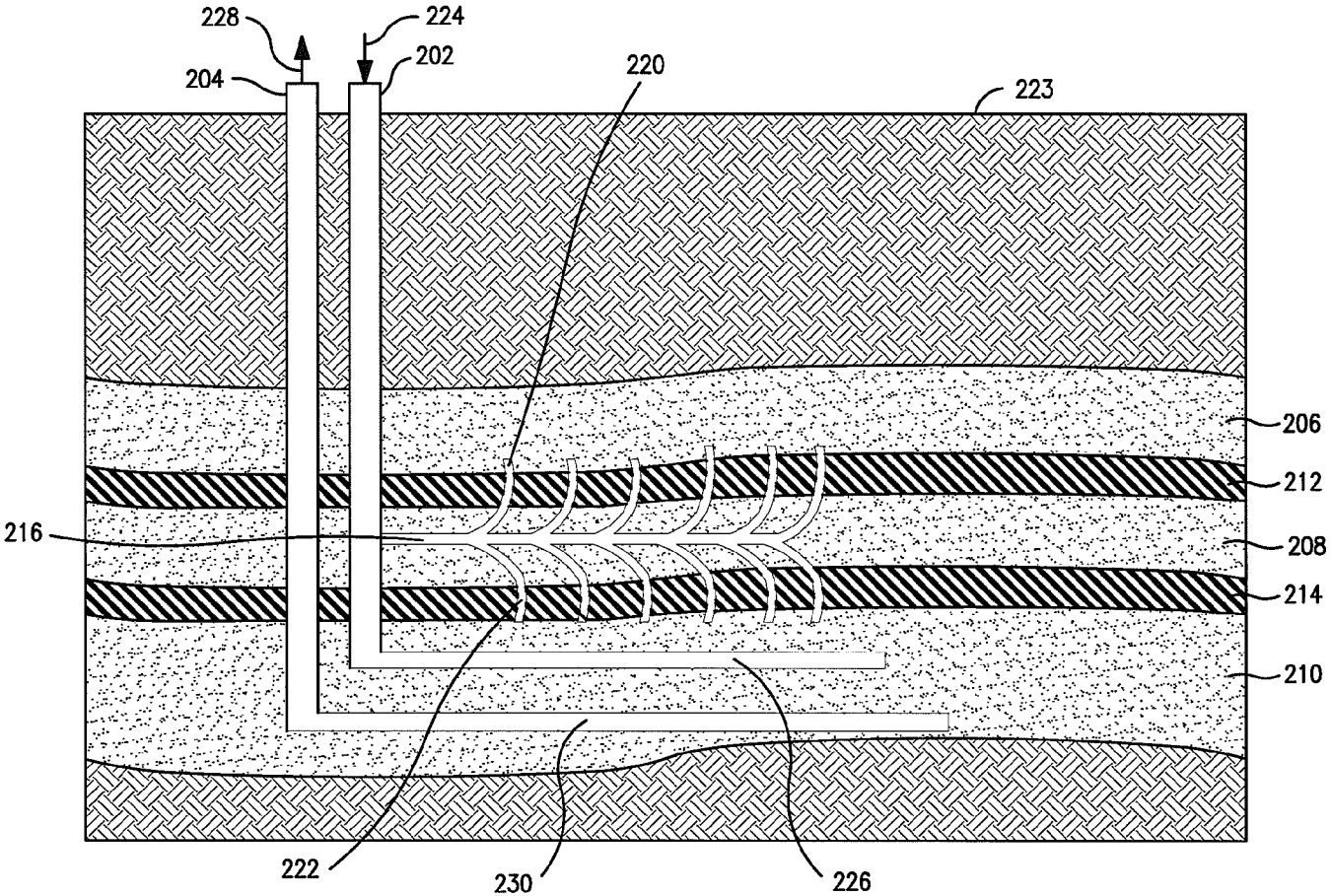
FIG. 2 is a schematic of a formation with bidirectional stratum puncturing boreholes arranged to facilitate hydrocarbon recovery utilizing an injection well and a production well, according to one embodiment of the invention.

FIG. 2 illustrates an injector well 202 and a producer well 204 drilled into first, second, and third reservoirs 206, 208, 210. A first stratum 212 initially isolates the first reservoir 206 closest to surface 223 from the second reservoir 208, which is disposed between the first reservoir 206 and the third reservoir 210 and is initially isolated from the third reservoir 210 by a second stratum 214. A lateral borehole 216 of the injector well 202 extends through the second reservoir 208 and branches out in upward and downward directions to puncture the first and second stratums 212, 214 at multiple discrete locations. The lateral borehole 216 thus creates first drilled bores 220 through the first stratum 212 and second drilled bores 222 through the second stratum 214.

The injection well 202 extends beyond the lateral borehole 216 into the third reservoir 210. After forming the lateral borehole 216 to establish fluid communication between the reservoirs 206, 208, 210 previously isolated from each other by the stratums 212, 214, cementing, plugging or casing may seal an exit window area where the lateral borehole 216 is initiated along the injector well 202 between the surface 223 and the third reservoir 210. Sealing off the lateral borehole 216 from a remainder of the injector well 202 ensures that steam 224 introduced into the injector well 202 bypasses the lateral borehole 216 and exits along an injector portion 226 that is deviated from vertical and disposed within the third reservoir 210.

While shown drilled in combination with the injector well 202, diverting drilling off of the producer well 204 in a like manner may form the lateral borehole 216 to condition the reservoirs 206, 208, 210 in some embodiments. Making conditioning of the reservoirs 206, 208, 210 part of drilling operations to create the injector well 202 or the producer well 204 consolidates expense and time needed for separate well drilling. The lateral borehole 216 takes one of various configurations, such as described herein, based on specific application regardless of how the lateral borehole 216 is originated from the surface 223.

In operation, production fluid 228 recovered from the producer well 204 includes condensate of the steam 224 mixed with the hydrocarbons from the reservoirs 206, 208, 210. The production fluid 228 collects in a section 230 of the producer well 204 where the producer well 204 is open to inflow, deviated from vertical and within the third reservoir 210. Similar to as described with respect to FIG. 1, the drilled bores 220, 222 provide passageways for vertical flow of fluids through the first and second stratums 212, 214.

Figure 3:
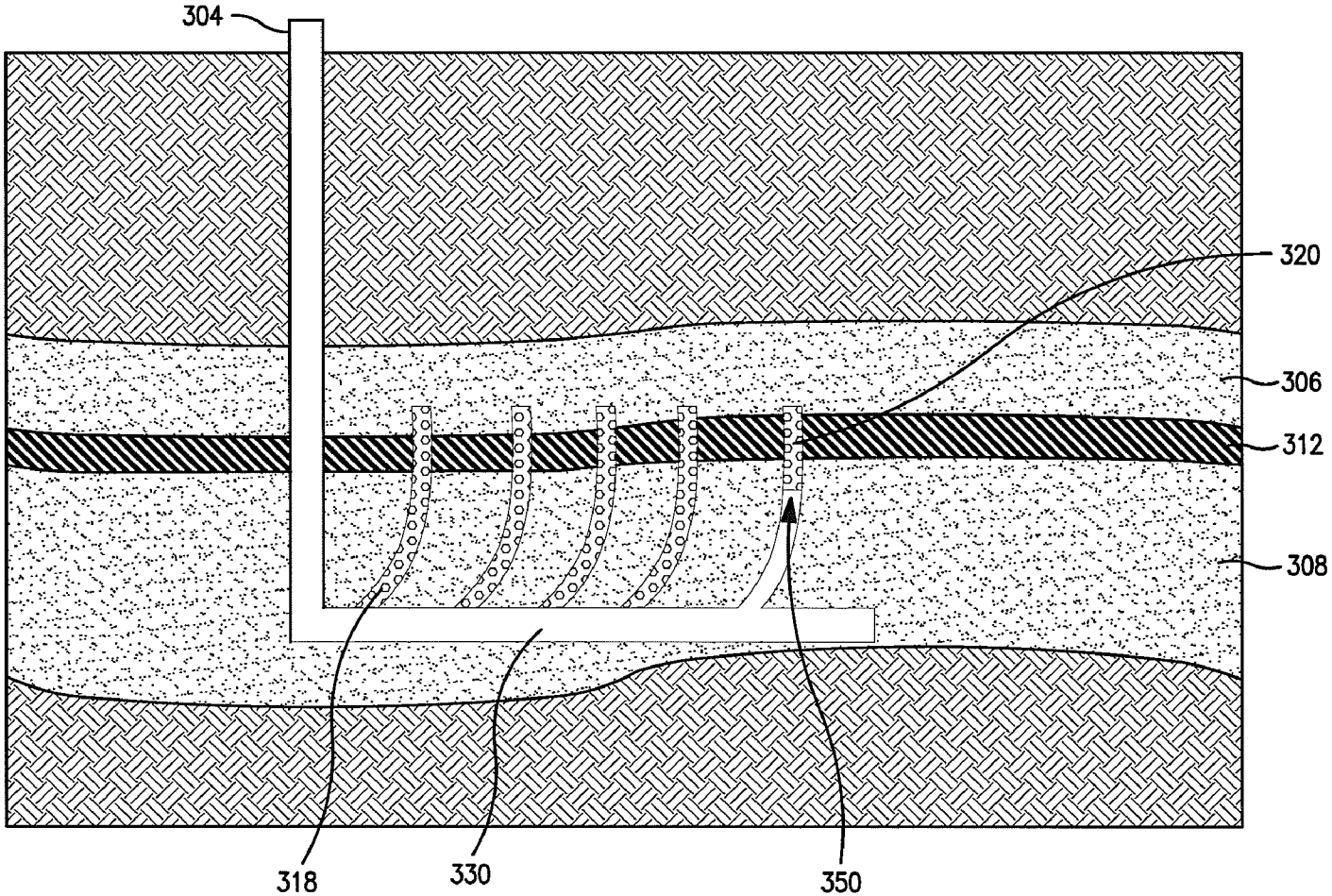
FIG. 3 is a schematic of a formation with bottom-up stratum puncturing boreholes arranged to facilitate hydrocarbon recovery utilizing a horizontal well, according to one embodiment of the invention.

FIG. 3 shows a well 304 utilized for hydrocarbon recovery from first and second reservoirs 306, 308. A stratum 312 initially obstructs fluid communication between the first reservoir 306 and the second reservoir 308 prior to drilling bottom-up stratum puncturing boreholes 318 arranged to facilitate the hydrocarbon recovery. The boreholes 318 extend upward from a section 330 of the well 304 where the well 304 is deviated from vertical and within the second reservoir 308. For some embodiments, the section 330 further permits inflow of the hydrocarbons into an interior of the well 304 for recovery to surface.

During use, the hydrocarbons from the first reservoir 306 flow through the boreholes 318 toward the section 330 of the well 304. For sufficiently light hydrocarbons, the boreholes 318 make possible gravity induced flow from the first reservoir 306 into the well 304 without any pretreatment of the hydrocarbons to alter viscosity of the hydrocarbons. In some embodiments, electric based heaters such as conductive heating elements disposed along the section 330 of the well 304 generate heat transferred to surrounding hydrocarbons. For some embodiments, cyclic steam stimulation techniques performed through the well 304 promote recovery of the hydrocarbons from the first and second reservoirs 306, 308.

The cyclic steam stimulation includes repeating stages of steam injection, soaking and production. The steam injection passes through the well 304 a slug of steam that is introduced into the reservoirs 306, 308 via outflow along the section 330 of the well 304. Following the steam injection, a soaking period with the well 304 shut-in allows uniform heat distribution. Once heated by the steam injection and soaking, the hydrocarbons become thin enough to produce through the well 304.

For some embodiments, a packing material 350 fills the boreholes 318. The packing material 350 maintains permeability through the stratum 312 and may be disposed in passageways 320 formed where the boreholes 318 traverse the stratum without completely filling each of the boreholes 318. Examples of the packing material 350 include sand, gravel pack, or granular proppant supplied through the well 304 from surface. Filling the passageways 320 ensures control of permeability across the stratum 312 since the boreholes 318 may tend to collapse resulting in lower permeability characteristics than desired. Any drilled bores through stratums to establish flow paths as described herein may include the packing material 350 or be left open-hole.

Figure 4:
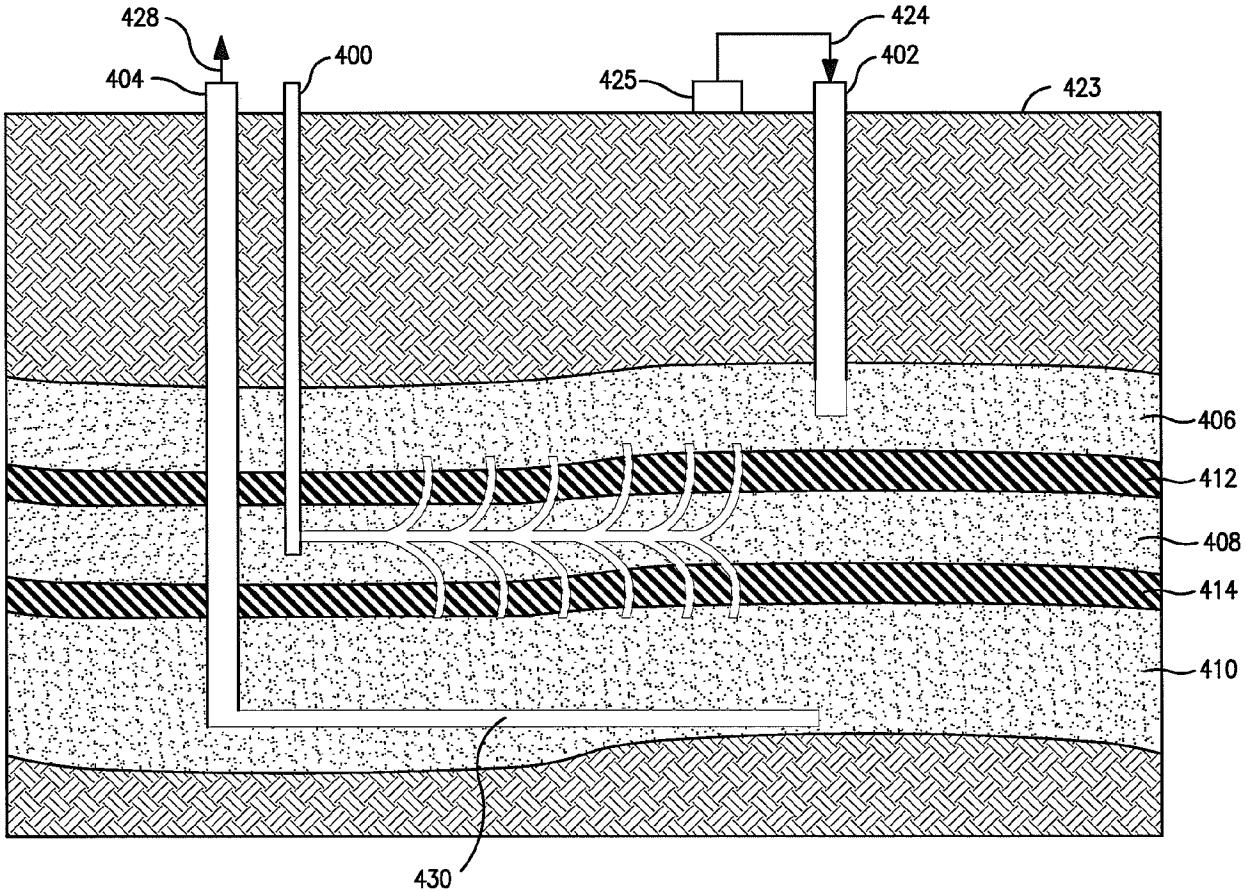
FIG. 4 is a schematic of a formation with stratum puncturing boreholes arranged to facilitate hydrocarbon recovery utilizing a top injection well and a bottom production well, according to one embodiment of the invention.

FIG. 4 illustrates a conditioning well 400, an injector well 402, and a producer well 404 drilled into earth. The conditioning well 400 establishes fluid communication between first, second and third reservoirs 406, 408, 410 by penetrating first and second stratums 412, 414 in an arrayed pattern of locations. For some embodiments, the injector well 402 terminates within the first reservoir 406 located closest to surface 423 relative to the second and third reservoirs 408, 410. An injectant 424 supplied from a source 425 flows out of the injector well 402 into the first reservoir 406. In some embodiments, the injectant 424 includes an oxidant such as oxygen or an oxygen-containing gas mixture to promote in-situ combustion.

With the in-situ combustion, the hydrocarbons in one or more of the reservoirs 406, 408, 410 ignite and a combustion front propagates through the one or more of the reservoirs 406, 408, 410. With the configuration of the injector well 402 and producer well 404 as depicted in FIG. 4, the combustion front propagates top-down and in a direction corresponding with toe-to-heel of the producer well 404. The in-situ combustion heats the hydrocarbons ahead of the combustion front and produces a pressure gradient driving the hydrocarbons that are heated toward a section 430 of the producer well 404 where the producer well 404 is open to inflow, deviated from vertical and within the third reservoir 410 located below the first and second reservoirs 406, 408. Produced fluids 428 from the producer well 404 includes the hydrocarbons recovered at the section 430 of the producer well 404. The produced fluids 428 may further include combustion gasses generated during the in-situ combustion. The conditioning well 400 enables gravity induced drainage from any of the reservoirs 406, 408, 410 heated by the in-situ combustion and/or establishes fluid communication necessary between the injector well 402 and the producer well 404 to maintain propagation of the combustion front.

For some embodiments, any displacement fluid forms the injectant 424, which may be a gas such as nitrogen, carbon dioxide, or mixtures thereof. As used herein, conditioning fluids thus include such displacement fluids, steam, water, and/or oxidants for use in facilitating hydrocarbon recovery regardless of how recovery is being facilitated by the conditioning fluid. The injectant 424 enhances recovery by creating pressure to drive the hydrocarbons and/or being miscible with the hydrocarbons to reduce viscosity of the hydrocarbons. The injectant 424 may thereby cause migration of the hydrocarbons from the first, second and third reservoirs 406, 408, 410 into the producer well 404 without heating of the hydrocarbons. Some embodiments utilize the injectant 424 introduced through the injector well 402 in combination with other techniques such as steam assisted gravity drainage, in-situ combustion or cyclic steam stimulation. Various combinations of production processes described herein may benefit from any disclosed configurations for drilled bores through stratums to establish flow paths.

The preferred embodiment of the present invention has been disclosed and illustrated. However, the invention is intended to be as broad as defined in the claims below. Those skilled in the art may be able to study the preferred embodiments and identify other ways to practice the invention that are not exactly as described herein. It is the intent of the inventors that variations and equivalents of the invention are within the scope of the claims below and the description, abstract and drawings are not to be used to limit the scope of the invention.

What is claimed is:

1. A method comprising the steps of:

drilling first and second bores through a stratum having lower permeability than hydrocarbon bearing first and second reservoirs, wherein the first reservoir and the second reservoir are stratified such that the first reservoir is separated from the second reservoir by the stratum; and recovering in a section of a production wellbore hydrocarbons from both the first reservoir and the second reservoir, wherein the section of the production wellbore is deviated from vertical and disposed in the first reservoir with the first and second bores establishing fluid communication between the second reservoir and the section of the production wellbore;

and wherein the first and second bores are filled with a particulate material.

2. The method according to claim 1, further comprising supplying steam into the first and second reservoirs, wherein the steam is introduced into the second reservoir upon the steam passing through the first reservoir and passing through the first and second bores and hydrocarbons are recovered in the section of the production wellbore both from the second reservoir upon being drained through the first and second bores and from the first reservoir.

3. A production system for recovering hydrocarbons from a formation, comprising:

first and second drilled bores through a stratum having lower permeability than hydrocarbon bearing first and second reservoirs, wherein the first reservoir and the second reservoir are stratified such that the first reservoir is separated from the second reservoir by the stratum; and a production wellbore having a section that is deviated from vertical and disposed in the first reservoir in fluid communication with both the first reservoir and the second reservoir, wherein the first and second drilled bores define part of fluid flow paths between the second reservoir and the section of the production wellbore;

and wherein the first and second drilled bores are filled with a particulate material.

4. The production system according to claim 3, wherein the section of the production wellbore extends in a horizontal direction.

5. The production system according to claim 3, further comprising an injection well coupled to a steam supply, wherein the injection well includes an injector portion above and parallel to the section of the production wellbore.

6. The production system according to claim 3, wherein the first and second drilled bores are offset from one another in a direction corresponding with orientation that the section of the production wellbore is deviated from vertical.

7. The production system according to claim 3, wherein laterals off of a horizontal borehole length define the first and second drilled bores.

* * * * *